US011587720B2

(12) United States Patent
Hirukawa

(10) Patent No.: US 11,587,720 B2
(45) Date of Patent: Feb. 21, 2023

(54) MULTILAYER COIL COMPONENT

(71) Applicant: Murata Manufacturing Co., Ltd., Kyoto-fu (JP)

(72) Inventor: Atsuo Hirukawa, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 327 days.

(21) Appl. No.: 16/881,866

(22) Filed: May 22, 2020

(65) Prior Publication Data

US 2020/0373069 A1 Nov. 26, 2020

(30) Foreign Application Priority Data

May 24, 2019 (JP) ..... JP2019-097640

(51) Int. Cl.
*H01F 27/28* (2006.01)
*H01F 27/29* (2006.01)
*H01F 17/00* (2006.01)

(52) U.S. Cl.
CPC ..... *H01F 27/2804* (2013.01); *H01F 17/0013* (2013.01); *H01F 27/292* (2013.01); *H01F 2027/2809* (2013.01)

(58) Field of Classification Search
CPC ..... H01F 17/0013; H01F 27/292; H01F 2017/0066; H01F 2027/2809; H01F 27/2804
See application file for complete search history.

(56) References Cited

U.S. PATENT DOCUMENTS

2014/0333405 A1 11/2014 Choto et al.
2016/0293301 A1* 10/2016 Choto ..... H01F 17/0013
(Continued)

FOREIGN PATENT DOCUMENTS

CN 104143404 A 11/2014
CN 106133860 A 11/2016
(Continued)

OTHER PUBLICATIONS

Takesue, Masafumi, Hiromichi Hayashi, and Richard L. Smith Jr. "Thermal and chemical methods for producing zinc silicate (willemite): a review." Progress in Crystal Growth and Characterization of Materials 55.3-4 (2009): 98-124. (Year: 2009).*
(Continued)

*Primary Examiner* — Ryan Johnson
(74) *Attorney, Agent, or Firm* — Studebaker & Brackett PC

(57) ABSTRACT

A multilayer coil component includes a multilayer body formed by stacking a plurality of insulating layers in a length direction and that has a built-in coil, and first and second outer electrodes that are electrically connected to the coil. The coil is formed by a plurality of coil conductors stacked in the length direction being electrically connected to each other. The first and second outer electrodes respectively extend along and cover at least parts of first and second end surfaces and parts of a first main surface. A stacking direction of the multilayer body and a coil axis direction of the coil are parallel to the first main surface. A low-dielectric-constant layer having a smaller relative dielectric constant than the insulating layers is provided between the multilayer body and the part of the first outer electrode that extends along the first main surface.

20 Claims, 12 Drawing Sheets

(56) References Cited

U.S. PATENT DOCUMENTS

| | | | |
|---|---|---|---|
| 2017/0018356 | A1 | 1/2017 | Matsushita |
| 2018/0166206 | A1 | 6/2018 | Ueyama et al. |

FOREIGN PATENT DOCUMENTS

| | | | | | |
|---|---|---|---|---|---|
| CN | 108231333 | A | | 6/2018 | |
| JP | H09-129447 | A | | 5/1997 | |
| JP | 09246046 | A | * | 9/1997 | |
| JP | H10-92645 | A | | 4/1998 | |
| JP | 2014-220469 | A | | 11/2014 | |
| JP | 2018-098368 | A | | 6/2018 | |
| KR | 2018056239 | A | * | 5/2018 | ..... H01F 17/0013 |
| WO | 2015/151810 | A1 | | 10/2015 | |

OTHER PUBLICATIONS

An Office Action; "Notice of Reasons for Refusal," mailed by the Japanese Patent Office dated Nov. 30, 2021, which corresponds to Japanese Patent Application No. 2019-097640 and is related to U.S. Appl. No. 16/881,866 with English translation.

* cited by examiner

MULTILAYER COIL COMPONENT

CROSS-REFERENCE TO RELATED APPLICATION

This application claims benefit of priority to Japanese Patent Application No. 2019-097640, filed May 24, 2019, the entire content of which is incorporated herein by reference.

BACKGROUND

Technical Field

The present disclosure relates to a multilayer coil component.

Background Art

As an example of a multilayer coil component, Japanese Unexamined Patent Application Publication No. 09-129447 discloses a multilayer coil in which the stacking direction of insulating sheets and the coil axis of the multilayer coil are parallel to the mounting surface of the multilayer coil.

However, there is a problem with the multilayer coil disclosed in Japanese Unexamined Patent Application Publication No. 09-129447 in that although stray capacitances can be reduced due to the outer electrodes not being provided on the mounting surface side of the multilayer coil, the multilayer coil has poor mountability. On the other hand, in response to the increasing communication speed and miniaturization of electronic devices in recent years, it is demanded that multilayer inductors have satisfactory radio-frequency characteristics in a high-frequency band (for example, a GHz band located at frequencies greater than or equal to 50 GHz). However, there is a risk that the characteristics will not be satisfactory in a high-frequency band of around 50 GHz in the multilayer coil disclosed in Japanese Unexamined Patent Application Publication No. 09-129447. Furthermore, if the outer electrodes were provided on the mounting surface side of the multilayer coil disclosed in Japanese Unexamined Patent Application Publication No. 09-129447, there would be problems in that stray capacitances would be undesirably generated between the outer electrodes and inner conductors and it would be difficult to realize both satisfactory mountability and radio-frequency characteristics.

SUMMARY

The present disclosure was made in order to solve the above-described problems and it is an object thereof to provide a multilayer coil component that has excellent mountability and radio-frequency characteristics.

A multilayer coil component according to a preferred embodiment of the present disclosure includes a multilayer body that is formed by stacking a plurality of insulating layers on top of one another in a length direction and that has a coil built into the inside thereof; and a first outer electrode and a second outer electrode that are electrically connected to the coil. The coil is formed by a plurality of coil conductors stacked in the length direction together with the insulating layers being electrically connected to each other. The multilayer body has a first end surface and a second end surface, which face each other in the length direction, a first main surface and a second main surface, which face each other in a height direction perpendicular to the length direction, and a first side surface and a second side surface, which face each other in a width direction perpendicular to the length direction and the height direction. The first outer electrode extends along and covers at least part of the first end surface and part of the first main surface. The second outer electrode extends along and covers at least part of the second end surface and part of the first main surface. A stacking direction of the multilayer body and a coil axis direction of the coil are parallel to the first main surface. A low-dielectric-constant layer having a smaller relative dielectric constant than the insulating layers is provided between the multilayer body and a part of the first outer electrode that extends along the first main surface.

According to the preferred embodiment of the present disclosure, a multilayer coil component can be provided that has excellent mountability and radio-frequency characteristics.

Other features, elements, characteristics and advantages of the present disclosure will become more apparent from the following detailed description of preferred embodiments of the present disclosure with reference to the attached drawings.

DETAILED DESCRIPTION

Hereafter, multilayer coil components according to embodiments of the present disclosure will be described.

However, the present disclosure is not limited to the following embodiments and the present disclosure can be applied with appropriate modifications within a range that does not alter the gist of the present disclosure. Combinations consisting of two or more desired configurations among the configurations described below are also included in the scope of the present disclosure.

Figure 1:
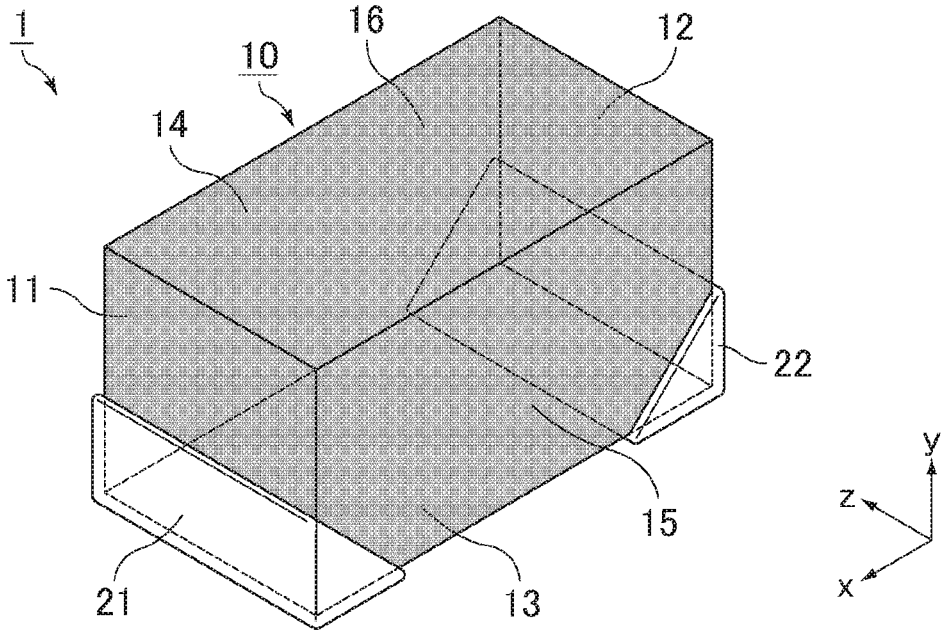
FIG. 1 is a perspective view schematically illustrating an example of a multilayer coil component according to an embodiment of the present disclosure.
Figure 2A:
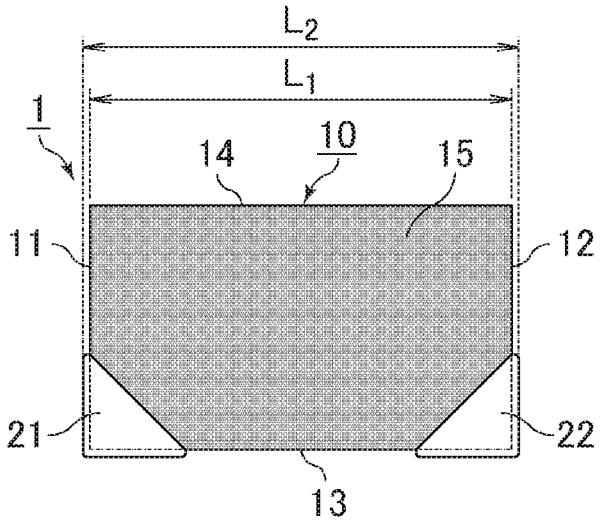
FIG. 2A is a side view of the multilayer coil component illustrated in FIG. 1.
Figure 2B:
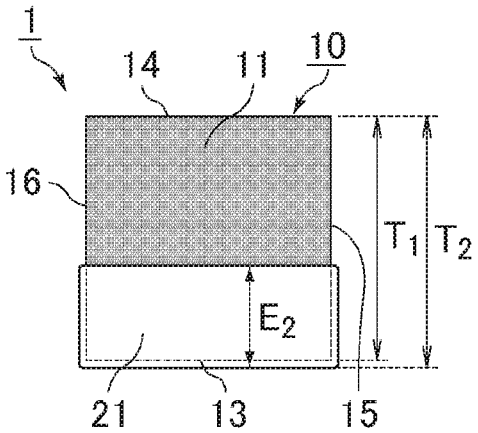
FIG. 2B is a front view of the multilayer coil component illustrated in FIG. 1.
Figure 2C:
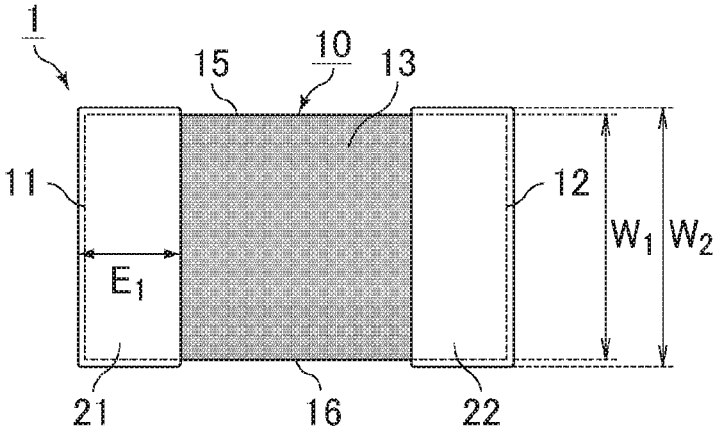
FIG. 2C is a bottom view of the multilayer coil component illustrated in FIG. 1.

FIG. 1 is a perspective view schematically illustrating an example of a multilayer coil component according to an embodiment of the present disclosure. FIG. 2A is a side view of the multilayer coil component illustrated in FIG. 1, FIG. 2B is a front view of the multilayer coil component illustrated in FIG. 1, and FIG. 2C is a bottom view of the multilayer coil component illustrated in FIG. 1.

A multilayer coil component 1 illustrated in FIGS. 1, 2A, 2B, and 2C includes a multilayer body 10, a first outer electrode 21, and a second outer electrode 22. The multilayer body 10 has a substantially rectangular parallelepiped shape having six surfaces. The configuration of the multilayer body 10 will be described later, but the multilayer body 10 is formed by stacking a plurality of insulating layers on top of one another in a length direction and has a coil built into the inside thereof. The first outer electrode 21 and the second outer electrode 22 are electrically connected to the coil.

In the multilayer coil component 1 and the multilayer body 10 of the embodiment of the present disclosure, a length direction, a height direction, and a width direction are respectively an x direction, a y direction, and a z direction in FIG. 1. Here, the length direction (x direction), the height direction (y direction), and the width direction (z direction) are perpendicular to each other.

As illustrated in FIGS. 1, 2A, 2B, and 2C, the multilayer body 10 has a first end surface 11 and a second end surface 12, which face each other in the length direction (x direction), a first main surface 13 and a second main surface 14, which face each other in the height direction (y direction) perpendicular to the length direction, and a first side surface 15 and a second side surface 16, which face each other in the width direction (z direction) perpendicular to the length direction and the height direction.

Although not illustrated in FIG. 1, corner portions and edge portions of the multilayer body 10 are preferably rounded. The term "corner portion" refers to a part of the multilayer body 10 where three surfaces intersect and the term "edge portion" refers to a part of the multilayer body 10 where two surfaces intersect.

The first outer electrode 21 is arranged so as to cover part of the first end surface 11 of the multilayer body 10 as illustrated in FIGS. 1 and 2B and so as to extend from the first end surface 11 and cover part of the first main surface 13 of the multilayer body 10, as illustrated in FIGS. 1 and 2C. As illustrated in FIG. 2B, the first outer electrode 21 covers a region of the first end surface 11 that includes the edge portion that intersects the first main surface 13, and may extend from the first end surface 11 so as to cover the second main surface 14.

In FIG. 2B, the height of the part of the first outer electrode 21 that covers the first end surface 11 of the multilayer body 10 is constant, but the shape of the first outer electrode 21 is not particularly limited so long as the first outer electrode 21 covers part of the first end surface 11 of the multilayer body 10. For example, the first outer electrode 21 may have an arch-like shape that increases in height from the ends thereof toward the center thereof on the first end surface 11 of the multilayer body 10. In addition, in FIG. 2C, the length of the part of the first outer electrode 21 that covers the first main surface 13 of the multilayer body 10 is constant, but the shape of the first outer electrode 21 is not particularly limited so long as the first outer electrode 21 covers part of the first main surface 13 of the multilayer body 10. For example, the first outer electrode 21 may have an arch-like shape that increases in length from the ends thereof toward the center thereof on the first main surface 13 of the multilayer body 10.

As illustrated in FIGS. 1 and 2A, the first outer electrode 21 may be additionally arranged so as to extend from the first end surface 11 and the first main surface 13 and cover part of the first side surface 15 and part of the second side surface 16. In this case, as illustrated in FIG. 2A, the parts of the first outer electrode 21 covering the first side surface 15 and the second side surface 16 are preferably formed in a diagonal shape relative to both the edge portion that intersects the first end surface 11 and the edge portion that intersects the first main surface 13. However, the first outer electrode 21 does not have to be arranged so as to cover part of the first side surface 15 and part of the second side surface 16.

The second outer electrode 22 is arranged so as to cover part of the second end surface 12 of the multilayer body 10 and so as to extend from the second end surface 12 and cover part of the first main surface 13 of the multilayer body 10. Similarly to the first outer electrode 21, the second outer electrode 22 covers a region of the second end surface 12 that includes the edge portion that intersects the first main surface 13.

In addition, similarly to the first outer electrode 21, the second outer electrode 22 may extend from the second end surface 12 and cover part of the second main surface 14, part of the first side surface 15, and part of the second side surface 16.

Similarly to the first outer electrode 21, the shape of the second outer electrode 22 is not particularly limited so long as the second outer electrode 22 covers part of the second end surface 12 of the multilayer body 10. For example, the second outer electrode 22 may have an arch-like shape that increases in height from the ends thereof toward the center thereof on the second end surface 12 of the multilayer body 10. Furthermore, the shape of the second outer electrode 22 is not particularly limited so long as the second outer electrode 22 covers part of the first main surface 13 of the multilayer body 10. For example, the second outer electrode 22 may have an arch-like shape that increases in length from the ends thereof toward the center thereof on the first main surface 13 of the multilayer body 10.

Similarly to the first outer electrode 21, the second outer electrode 22 may be additionally arranged so as to extend from the second end surface 12 and the first main surface 13 and cover part of the second main surface 14, part of the first side surface 15, and part of the second side surface 16. In this case, the parts of the second outer electrode 22 covering the first side surface 15 and the second side surface 16 are preferably formed in a diagonal shape relative to both the edge portion that intersects the second end surface 12 and the edge portion that intersects the first main surface 13. However, the second outer electrode 22 does not have to be arranged so as to cover part of the second main surface 14, part of the first side surface 15, and part of the second side surface 16.

Since the first outer electrode 21 and the second outer electrode 22 are arranged in the manner described above, when the multilayer coil component 1 is to be mounted on a substrate, the multilayer coil component 1 can be easily mounted by using the first main surface 13 of the multilayer body 10 as the mounting surface.

Although the size of the multilayer coil component 1 according to the embodiment of the present disclosure is not particularly limited, the multilayer coil component 1 is preferably the 0603 size, the 0402 size, or the 1005 size.

In the case where the multilayer coil component 1 according to the embodiment of the present disclosure is the 0603 size, the length of the multilayer body 10 (length indicated by double-headed arrow $L_1$ in FIG. 2A) preferably lies in a range from 0.57 mm to 0.63 mm. In the case where the multilayer coil component 1 according to the embodiment of the present disclosure is the 0603 size, the width of the multilayer body 10 (length indicated by double-headed arrow $W_1$ in FIG. 2C) preferably lies in a range from 0.27 mm to 0.33 mm. In the case where the multilayer coil component 1 according to the embodiment of the present disclosure is the 0603 size, the height of the multilayer body 10 (length indicated by double-headed arrow $T_1$ in FIG. 2B) preferably lies in a range from 0.27 mm to 0.33 mm.

In the case where the multilayer coil component 1 according to the embodiment of the present disclosure is the 0603 size, the length of the multilayer coil component 1 (length indicated by double arrow $L_2$ in FIG. 2A) preferably lies in a range from 0.57 mm to 0.63 mm. In the case where the multilayer coil component 1 according to the embodiment of the present disclosure is the 0603 size, the width of the multilayer coil component 1 (length indicated by double-headed arrow $W_2$ in FIG. 2C) preferably lies in a range from 0.27 mm to 0.33 mm. In the case where the multilayer coil component 1 according to the embodiment of the present disclosure is the 0603 size, the height of the multilayer coil component 1 (length indicated by double-headed arrow $T_2$ in FIG. 2B) preferably lies in a range from 0.27 mm to 0.33 mm.

In the case where the multilayer coil component 1 according to the embodiment of the present disclosure is the 0603 size, the length of the part of the first outer electrode 21 that covers the first main surface 13 of the multilayer body 10 (length indicated by double-headed arrow E1 in FIG. 2C) preferably lies in a range from 0.12 mm to 0.22 mm. Similarly, the length of the part of the second outer electrode 22 that covers the first main surface 13 of the multilayer body 10 preferably lies in a range from 0.12 mm to 0.22 mm Additionally, in the case where the length of the part of the first outer electrode 21 that covers the first main surface 13 of the multilayer body 10 and the length of the part of the second outer electrode 22 that covers the first main surface 13 of the multilayer body 10 are not constant, it is preferable that the lengths of the longest parts thereof lie within the above-described range.

In the case where the multilayer coil component 1 according to the embodiment of the present disclosure is the 0603 size, the height of the part of the first outer electrode 21 that covers the first end surface 11 of the multilayer body 10 (length indicated by double-headed arrow $E_2$ in FIG. 2B) preferably lies in a range from 0.10 mm to 0.20 mm. Similarly, the height of the part of the second outer electrode 22 that covers the second end surface 12 of the multilayer body 10 preferably lies in a range from 0.10 mm to 0.20 mm. In this case, stray capacitances arising from the outer electrodes 21 and 22 can be reduced. In the case where the height of the part of the first outer electrode 21 that covers the first end surface 11 of the multilayer body 10 and the height of the part of the second outer electrode 22 that covers the second end surface 12 of the multilayer body 10 are not constant, it is preferable that the heights of the highest parts thereof lie within the above-described range.

In the case where the multilayer coil component 1 according to the embodiment of the present disclosure is the 0402 size, the length of the multilayer body 10 preferably lies in a range from 0.38 mm to 0.42 mm and the width of the multilayer body 10 preferably lies in a range from 0.18 mm to 0.22 mm. In the case where the multilayer coil component 1 according to the embodiment of the present disclosure is the 0402 size, the height of the multilayer body 10 preferably lies in a range from 0.18 mm to 0.22 mm.

In the case where the multilayer coil component 1 according to the embodiment of the present disclosure is the 0402 size, the length of the multilayer coil component 1 preferably lies in a range from 0.38 mm to 0.42 mm. In the case where the multilayer coil component 1 according to the embodiment of the present disclosure is the 0402 size, the width of the multilayer coil component 1 preferably lies in a range from 0.18 mm to 0.22 mm. In the case where the multilayer coil component 1 according to the embodiment of the present disclosure is the 0402 size, the height of the multilayer coil component 1 preferably lies in a range from 0.18 mm to 0.22 mm.

In the case where the multilayer coil component 1 according to the embodiment of the present disclosure is the 0402 size, the length of the part of the first outer electrode 21 that covers the first main surface 13 of the multilayer body 10 preferably lies in a range from 0.08 mm to 0.15 mm. Similarly, the length of the part of the second outer electrode 22 that covers the first main surface 13 of the multilayer body 10 preferably lies in a range from 0.08 mm to 0.15 mm.

In the case where the multilayer coil component 1 according to the embodiment of the present disclosure is the 0402 size, the height of the part of the first outer electrode 21 that covers the first end surface 11 of the multilayer body 10 preferably lies in a range from 0.06 mm to 0.13 mm. Similarly, the height of the part of the second outer electrode 22 that covers the second end surface 12 of the multilayer body 10 preferably lies in a range from 0.06 min to 0.13 mm. In this case, stray capacitances arising from the outer electrodes 21 and 22 can be reduced.

In the case where the multilayer coil component 1 according to the embodiment of the present disclosure is the 1005 size, the length of the multilayer body 10 preferably lies in a range from 0.95 mm to 1.05 mm and the width of the multilayer body 10 preferably lies in a range from 0.45 mm to 0.55 mm. In the case where the multilayer coil component 1 according to the embodiment of the present disclosure is the 1005 size, the height of the multilayer body 10 preferably lies in a range from 0.45 mm to 0.55 mm.

In the case where the multilayer coil component 1 according to the embodiment of the present disclosure is the 1005 size, the length of the multilayer coil component 1 preferably lies in a range from 0.95 mm to 1.05 mm. In the case where the multilayer coil component 1 according to the embodiment of the present disclosure is the 1005 size, the width of the multilayer coil component 1 preferably lies in a range from 0.45 mm to 0.55 mm. In the case where the multilayer coil component 1 according to the embodiment of the present disclosure is the 1005 size, the height of the multilayer coil component 1 preferably lies in a range from 0.45 mm to 0.55 mm.

In the case where the multilayer coil component 1 according to the embodiment of the present disclosure is the 1005 size, the length of the part of the first outer electrode 21 that covers the first main surface 13 of the multilayer body 10 preferably lies in a range from 0.20 mm to 0.38 mm. Similarly, the length of the part of the second outer electrode 22 that covers the first main surface 13 of the multilayer body 10 preferably lies in a range from 0.20 mm to 0.38 mm.

In the case where the multilayer coil component 1 according to the embodiment of the present disclosure is the 1005 size, the height of the part of the first outer electrode 21 that covers the first end surface 11 of the multilayer body 10 preferably lies in a range from 0.15 mm to 0.33 mm. Similarly, the height of the part of the second outer electrode 22 that covers the second end surface 12 of the multilayer body 10 preferably lies in a range from 0.15 mm to 0.33 mm. In this case, stray capacitances arising from the outer electrodes 21 and 22 can be reduced.

Figure 3:
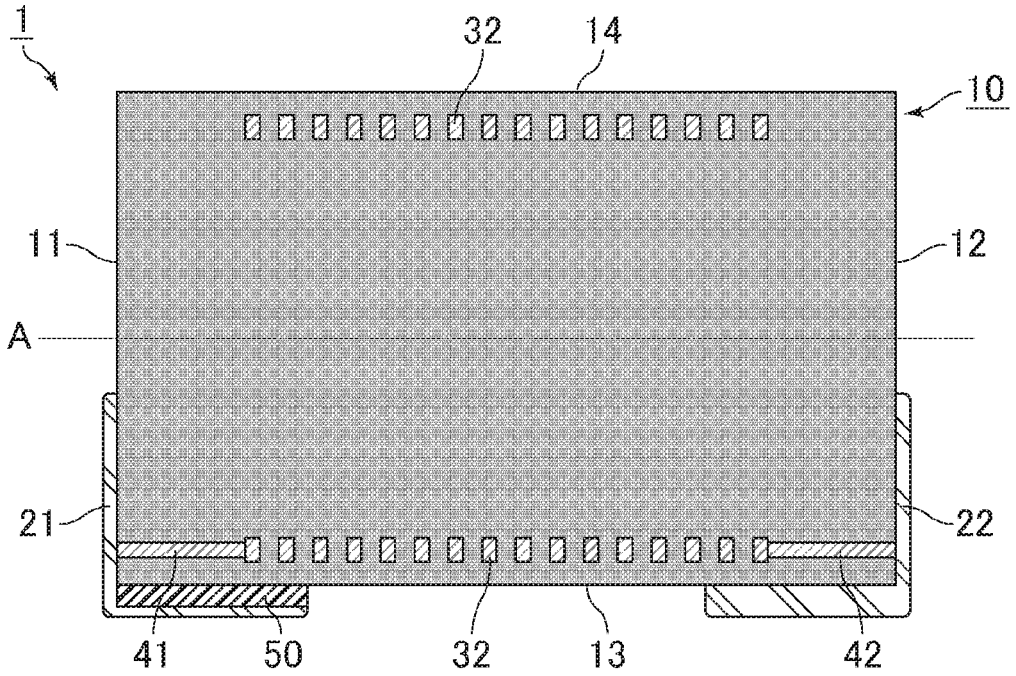
FIG. 3 is a sectional view schematically illustrating the internal structure of the multilayer coil component.

In the multilayer coil component 1 according to the embodiment of the present disclosure, insulating layers located between coil conductors are composed of a material containing at least one out of a magnetic material and a non-magnetic material. FIG. 3 is a sectional view schematically illustrating the internal structure of the multilayer coil component 1. FIG. 3 illustrates insulating layers, coil conductors, connection conductors, and a stacking direction of the multilayer body 10 in a schematic manner, and the actual shapes, connections, and so forth are not depicted with strict accuracy. For example, the coil conductors are connected to each other by via conductors. The stacking direction of the multilayer body 10 and the axial direction of the coil (coil axis is denoted by A in FIG. 3) are parallel to the first main surface 13, which is the mounting surface.

As illustrated in FIG. 3, the multilayer coil component 1 includes: the multilayer body 10, which has a coil built into the inside thereof, that is formed by electrically connecting together a plurality of coil conductors 32 that are stacked together with insulating layers; and the first outer electrode 21 and the second outer electrode 22, which are electrically connected to the coil. A low-dielectric-constant layer 50 is provided on the first main surface 13 of the multilayer body 10. A relative dielectric constant $\varepsilon_{r2}$ of the low-dielectric-constant layer 50 is smaller than a relative dielectric constant $\varepsilon_{r1}$ of the insulating layers of the multilayer body 10. The low-dielectric-constant layer 50 is arranged between the multilayer body 10 and the part of the first outer electrode 21 that extends along the first main surface 13 and consequently the low-dielectric-constant layer 50 can reduce a stray capacitance generated between the first outer electrode 21 and a conductor inside the multilayer body 10.

In the multilayer coil component 1 illustrated in FIG. 3, the first outer electrode 21 and the coil conductor 32 that faces the first outer electrode 21 are connected to each other by a first connection conductor 41 in a straight line and the second outer electrode 22 and the coil conductor 32 that faces the second outer electrode 22 are connected to each other by a second connection conductor 42 in a straight line. The first connection conductor 41 and the second connection conductor 42 are connected to the respective coil conductors 32 at the parts of the coil conductors 32 that are closest to the first main surface 13, which is the mounting surface. The first connection conductor 41 and the second connection conductor 42 overlap the coil conductors 32 in a plan view from the stacking direction and are positioned closer to the first main surface 13, which is the mounting surface, than the coil axis. Since the first connection conductor 41 and the second connection conductor 42 are both connected to the coil conductors 32 at the parts of the coil conductors 32 that are closest to the mounting surface, the outer electrodes 21 and 22 can be reduced in size and the radio-frequency characteristics can be improved.

Therefore, a stray capacitance generated between the first outer electrode 21 and a conductor inside the multilayer body 10 is reduced in the multilayer coil component 1 and the radio-frequency characteristics of the multilayer coil component 1 are improved. Regarding radio-frequency characteristics in a high-frequency band (in particular, a band from 30 GHz to 80 GHz), a transmission coefficient S21 at 40 GHz preferably lies in a range from −1 dB to 0 dB and the transmission coefficient S21 at 50 GHz preferably lies in a range from −1 dB to 0 dB. When the multilayer coil component 1 satisfies the above conditions, for example, the multilayer coil component 1 can be suitably used in a bias-tee circuit inside an optical communication circuit. The transmission coefficient S21 is obtained from the ratio of the power of a transmitted signal to the power of an input signal. The transmission coefficient S21 at each frequency can be obtained using a network analyzer, for example. The transmission coefficient S21 is basically a dimensionless quantity, but is usually expressed in dB using the common logarithm.

Figure 4:
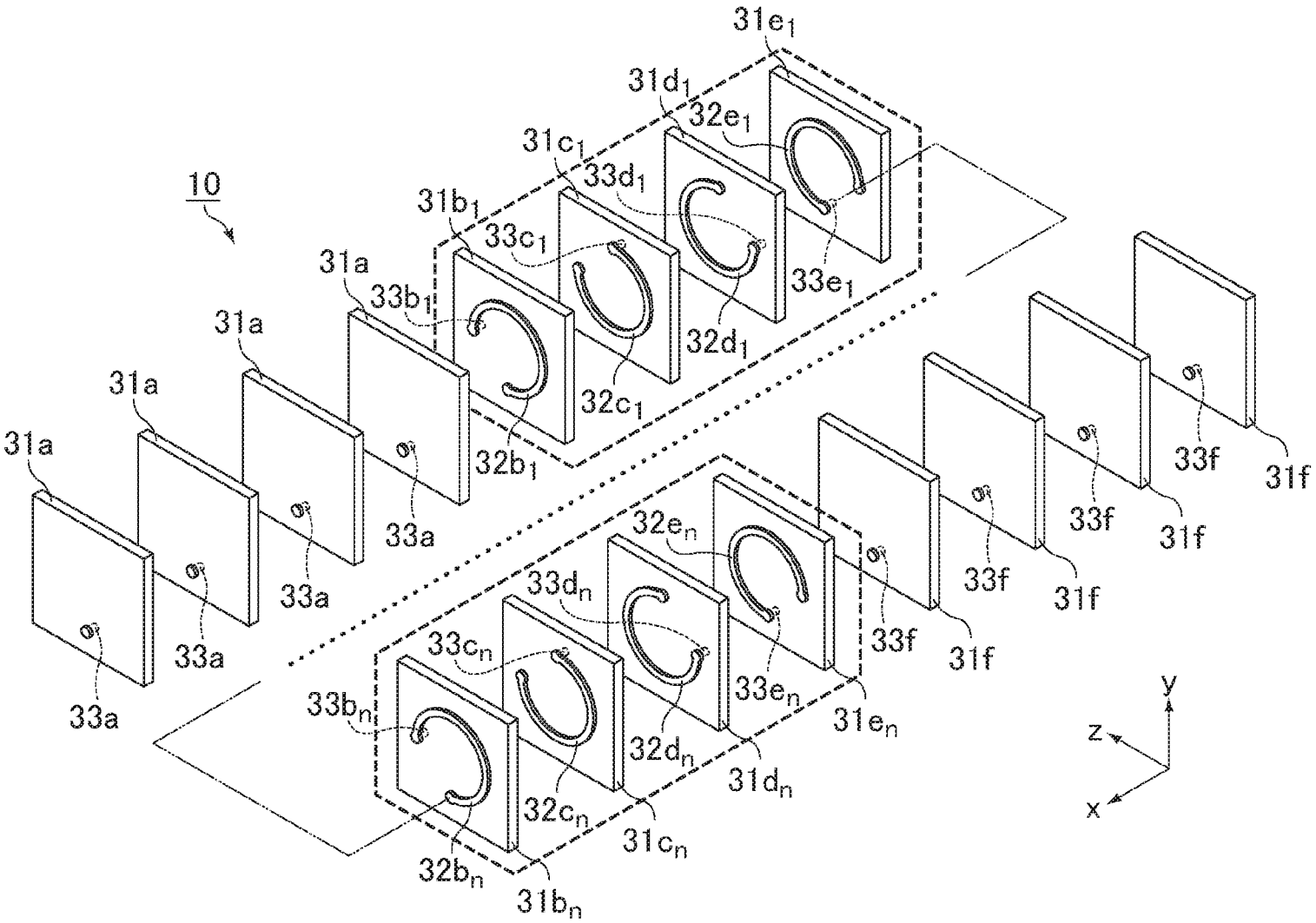
FIG. 4 is an exploded perspective view schematically illustrating an example of a multilayer body of the multilayer coil component illustrated in FIG. 1.
Figure 5:
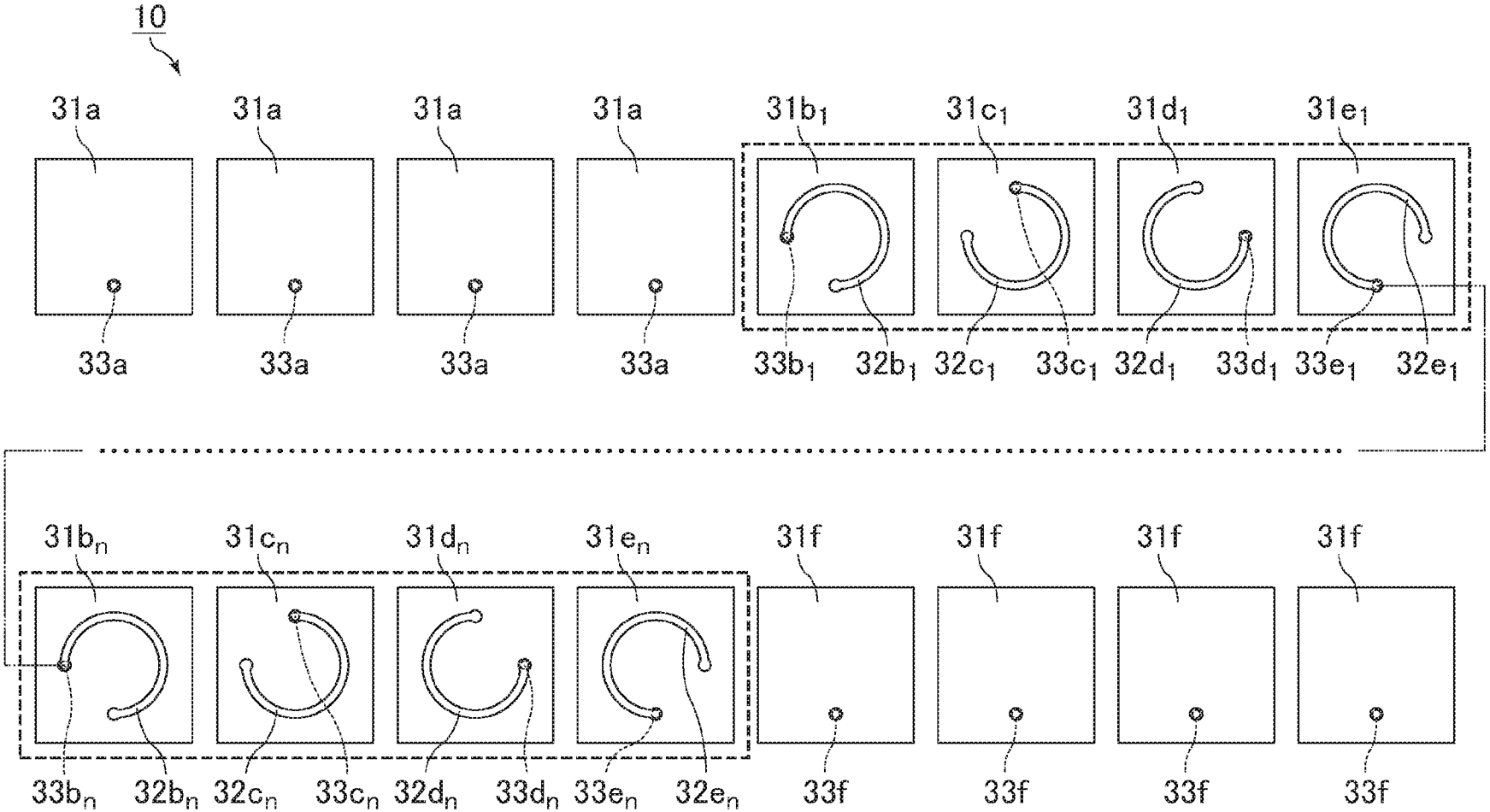
FIG. 5 is an exploded plan view schematically illustrating the example of the multilayer body of the multilayer coil component illustrated in FIG. 1.

FIG. 4 is an exploded perspective view schematically illustrating an example of the multilayer body 10 of the multilayer coil component 1 illustrated in FIG. 1 and FIG. 5 is an exploded plan view schematically illustrating the example of the multilayer body 10 of the multilayer coil component 1 illustrated in FIG. 1.

As illustrated in FIGS. 4 and 5, the multilayer body 10 is formed by stacking a plurality of insulating layers 31*a*, 31*b* (31*b*$_1$ to 31*b*$_n$), 31*c* (31*c*$_1$ to 31*c*$_n$), 31*d* (31*d*$_1$ to 31*d*$_n$), 31*e* (31*e*$_1$ to 31*e*$_n$), and 31*f* on top of one another in the length direction (x direction). The direction in which the plurality of insulating layers of the multilayer body 10 are stacked is called the stacking direction. In other words, in the multilayer coil component 1 of the embodiment of the present disclosure, the length direction of the multilayer body 10 and the stacking direction match each other.

Coil conductors 32*b* (32*b*$_1$ to 32*b*$_n$), 32*c* (32*c*$_1$ to 32*c*$_n$), 32*d* (32*d*$_1$ to 32*d*$_n$), and 32*e* (32*e*$_1$ to 32*e*$_n$) and via conductors 33*b* (33*b*$_1$ to 33*b*$_n$), 33*c* (33*c*$_1$ to 33*c*$_n$), 33*d* (33*d*$_1$ to 33*d*$_n$), and 33*e* (33*e*$_1$ to 33*e*$_n$) are respectively provided on and in the insulating layers 31*b* (31*b*$_1$ to 31*b*$_n$), 31*c* (31*c*$_1$ to 31*c*$_n$), 31*d* (31*d*$_1$ to 31*d*$_n$), and 31*e* (31*e*$_1$ to 31*e*$_n$). Via conductors 33*a* and 33*f* are respectively provided in the insulating layers 31*a* and 31*f*. The coil conductors 32*b* (32*b*$_1$ to 32*b*$_n$), 32*c* (32*c*$_1$ to 32*c*$_n$), 32*d* (32*d*$_1$ to 32*d*$_n$), and 32*e* (32*e*$_1$ to 32*e*$_n$) each include a line portion and land portions disposed at the ends of the line portion. As illustrated in FIGS. 4 and 5, it is preferable that the land portions be slightly larger than the line width of the line portions.

The coil conductors 32*b* (32*b*$_1$ to 32*b*$_n$), 32*c* (32*c*$_1$ to 32*c*$_n$), 32*d* (32*d*$_1$ to 32*d*$_n$), and 32*e* (32*e*$_1$ to 32*e*$_n$) are respectively provided on main surfaces of the insulating layers 31*b* (31*b*$_1$ to 31*b*$_n$), 31*c* (31*c*$_1$ to 31*c*$_n$), 31*d*(31*d*$_1$ to 31*d*$_n$), and 31*e* (31*e*$_1$ to 31*e*$_n$) and are stacked together with the insulating layers 31*a*, 31*b* (31*b*$_1$ to 31*b*$_n$), 31*c* (31*c*$_1$ to 31*c*$_n$), 31*d* (31*d*$_1$ to 31*d*$_n$), 31*e* (31*e*$_1$ to 31*e*$_n$), and 31*f*. In FIGS. 4 and 5, each coil conductor is shaped so as to extend through ¾ of a turn and the insulating layers 31*b*$_1$, 31*c*$_1$, 31*d*$_1$, and 31*e*$_1$ are repeatedly stacked as one unit (three turns).

The via conductors 33*a*, 33*b* (33*b*$_1$ to 33*b*$_n$), 33*c* (33*c*$_1$ to 33*c*$_n$), 33*d* (33*d*$_1$ to 33*d*$_n$), 33*e* (33*e*$_1$ to 33*e*$_n$), and 33*f* are respectively provided so as to penetrate through the insulating layers 31*a*, 31*b* (31*b*$_1$ to 31*b*$_n$), 31*c* (31*c*$_1$ to 31*c*$_n$), 31*d* (31*d*$_1$ to 31*d*$_n$), 31*e* (31*e*$_1$ to 31*e*$_n$), and 31*f* in the stacking direction (x direction in FIG. 4).

The thus-configured insulating layers 31*a*, 31*b* (31*b*$_1$ to 31*b*$_n$), 31*c* (31*c*$_1$ to 31*c*$_n$), 31*d* (31*d*$_1$ to 31*d*$_n$), 31*e* (31*e*$_1$ to 31*e*$_n$), and 31*f* are stacked on top of one another in the x direction as illustrated in FIG. 4. Thus, the coil conductors 32*b* (32*b*$_1$ to 32*b*$_n$), 32*c* (32*c*$_1$ to 32*c*$_n$), 32*d* (32*d*$_1$ to 32*d*$_n$), and 32*e* (32*e*$_1$ to 32*e*$_n$) are electrically connected to each other by the via conductors 33*b* (33*b*$_1$ to 33*b*$_n$), 33*c* (33*c*$_1$ to 33*c*$_n$), 33*d* (33*d*$_1$ to 33*d*$_n$), and 33*e* (33*e*$_1$ to 33*e*$_n$). As a result, a solenoid coil having a coil axis that extends in the x direction is formed inside the multilayer body 10.

In addition, the via conductors 33*a* and 33*f* form connection conductors inside the multilayer body 10 and are exposed at the two end surfaces of the multilayer body 10. One connection conductor is connected in a straight line between the first outer electrode 21 and the coil conductor 32*b*$_1$ that faces the first outer electrode 21 and the other connection conductor is connected in a straight line between the second outer electrode 22 and the coil conductor 32*e*$_n$ that faces the second outer electrode 22 inside the multilayer body 10.

The coil conductors forming the coil preferably overlap in a plan view from the stacking direction. In addition, the coil preferably has a substantially circular shape in a plan view from the stacking direction. In the case where the coil includes land portions, the shape of the coil is taken to be the shape obtained by removing the land portions (i.e., the shape of the line portions).

The phrase "the first connection conductor 41 is connected in a straight line between the first outer electrode 21 and the coil" means that the via conductors 33*a* forming the first connection conductor 41 overlap one another in a plan view from the stacking direction and it is not necessary for the via conductors 33*a* to be perfectly arranged in a straight line. In addition, the phrase "the second connection conductor 42 is connected in a straight line between the second outer electrode 22 and the coil" means that the via conductors 33*f* forming the second connection conductor 42 overlap one another in a plan view from the stacking direction and it is not necessary for the via conductors 33*f* to be perfectly arranged in a straight line. In the case where land portions are connected to the via conductors forming the connection conductors, the shape of the connection conductors is the shape obtained by removing the land portions (i.e., the shape of the via conductors).

The coil conductors illustrated in FIGS. 4 and 5 are shaped so that the repeating pattern has a substantially circular shape, but the coil conductors may instead be shaped so that the repeating pattern has a substantially polygonal shape such as a substantially quadrangular shape. Furthermore, the coil conductors illustrated in FIGS. 4 and 5 are not exposed at the surfaces of the multilayer body 10, but part of one or more of the coil conductors may be exposed at a surface of the multilayer body 10. However, it is preferable that a low-dielectric-constant layer be provided at the surface in a place where a coil conductor is exposed at a surface of the multilayer body 10.

In a plan view from the stacking direction, the line width of the line portions of the coil conductors preferably lies in a range from 30 μm to 80 μm and more preferably lies in the range from 30 μm to 60 μm. In the case where the line width of the line portions is smaller than 30 μm, the direct-current resistance of the coil may be large. In the case where the line width of the line portions is larger than 80 μm, the electrostatic capacitance of the coil may be large, and therefore the radio-frequency characteristics of the multilayer coil component 1 may be degraded.

The multilayer coil component 1 of the embodiment of the present disclosure is preferably configured so that the land portions are not positioned inside the inner periphery of the line portions and partially overlap the line portions in a plan view from the stacking direction. If the land portions are positioned inside the inner periphery of the line portions, the impedance may undesirably decrease. In addition, the diameter of the land portions is preferably 1.05 to 1.3 times the line width of the line portions in a plan view from the stacking direction.

If the diameter of the land portions is less than 1.05 times the line width of the line portions, the connections between the land portions and the via conductors may be unsatisfactory. On the other hand, if the diameter of the land portions is greater than 1.3 times the line width of the line portions, the radio-frequency characteristics may be degraded due to the stray capacitances arising from the land portions becoming larger.

The shape of the land portions in a plan view from the stacking direction may be a substantially circular shape or may be a substantially polygonal shape. In the case where the shape of the land portions is a substantially polygonal shape, the diameter of the land portions is taken to be the diameter of an area-equivalent circle of the polygonal shape.

In the multilayer coil component 1 according to the embodiment of the present disclosure, the low-dielectric-constant layer 50, which has a smaller relative dielectric constant than the insulating layers, is provided between the multilayer body 10 and the part of the first outer electrode 21 that extends along the first main surface 13 of the multilayer body 10. The low-dielectric-constant layer 50 is a layer that has a smaller relative dielectric constant than the insulating layers that form the multilayer body 10 and the low-dielectric-constant layer 50 is arranged between the multilayer body 10 and the part of the first outer electrode 21 that extends along the first main surface 13 of the multilayer body 10. When the low-dielectric-constant layer 50 is arranged between the multilayer body 10 and the part of the first outer electrode 21 that extends along the first main surface 13 of the multilayer body 10, a stray capacitance generated between the first outer electrode 21 and the multilayer body 10 can be reduced and the radio-frequency characteristics can be improved.

The low-dielectric-constant layer 50 is preferably provided over the entire surface between the multilayer body 10 and the part of first outer electrode 21 that extends along the first main surface 13 of the multilayer body 10 so that the first outer electrode 21 and the multilayer body 10 do not contact each other at the first main surface 13 of the multilayer body 10. When the low-dielectric-constant layer 50 is provided over the entire surface between the multilayer body 10 and the part of the first outer electrode 21 that extends along the first main surface 13 of the multilayer body 10, a stray capacitance generated between the first outer electrode 21 and the multilayer body 10 can be minimized and this further contributes to improvement of the radio-frequency characteristics.

Figure 6:
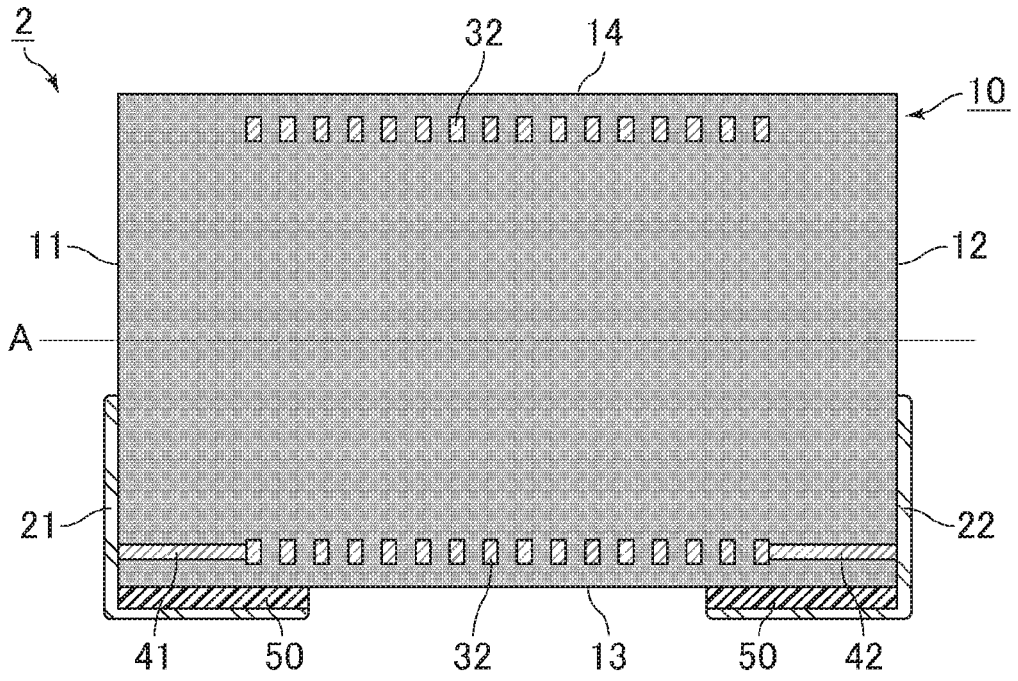
FIG. 6 is a sectional view schematically illustrating another example of a multilayer coil component according to an embodiment of the present disclosure.

Other examples of a position at which a low-dielectric-constant layer may be arranged will be described while referring to FIGS. 6 and 7. FIG. 6 is a sectional view schematically illustrating another example of a multilayer coil component according to an embodiment of the present disclosure. In a multilayer coil component 2 illustrated in FIG. 6, a low-dielectric-constant layer 50 is provided between the multilayer body 10 and the part of the first outer electrode 21 that extends along the first main surface 13 of the multilayer body 10 and a low-dielectric-constant layer 50 is provided between the multilayer body 10 and the part of the second outer electrode 22 that extends along the first main surface 13 of the multilayer body 10.

In the multilayer coil component 2 illustrated in FIG. 6, the low-dielectric-constant layers 50 are provided over the entire surfaces between the multilayer body 10 and the parts of the first outer electrode 21 and the second outer electrode 22 that extend along the first main surface 13 of the multilayer body 10 so that the parts of the first and second outer electrodes 21 and 22 that extend along the first main surface 13 of the multilayer body 10 do not contact the multilayer body 10.

Figure 7:
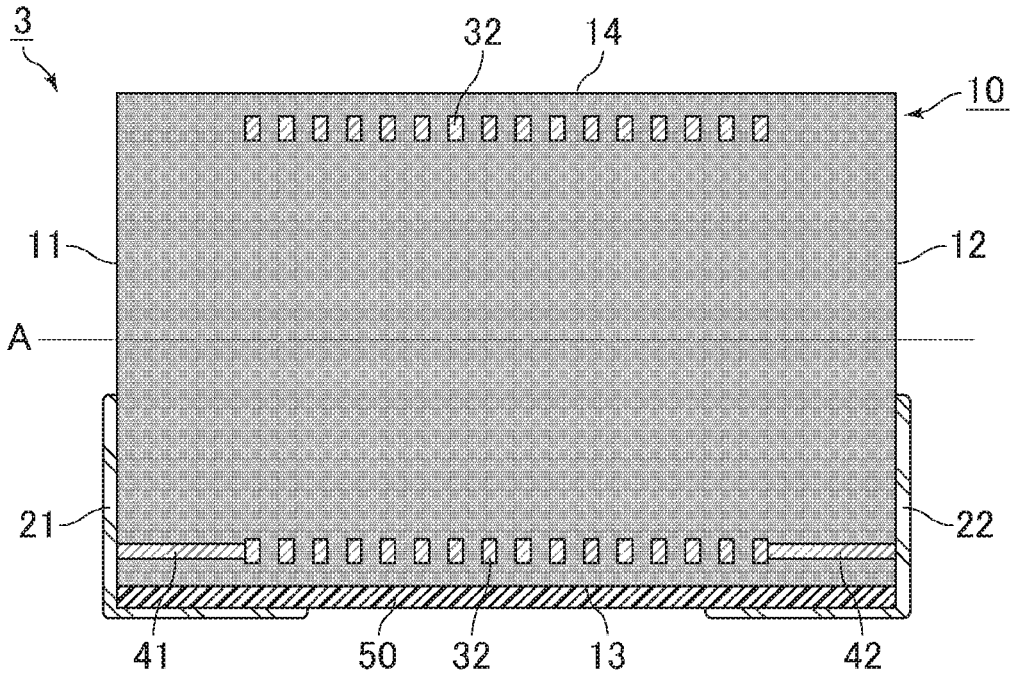
FIG. 7 is a sectional view schematically illustrating yet another example of a multilayer coil component according to an embodiment of the present disclosure.

FIG. 7 is a sectional view schematically illustrating yet another example of a multilayer coil component according to an embodiment of the present disclosure. In a multilayer coil component 3 illustrated in FIG. 7, the low-dielectric-constant layer 50 is provided along the entirety of the first main surface 13 of the multilayer body 10. Therefore, the low-dielectric-constant layer 50 is provided between the multilayer body 10 and the part of the first outer electrode 21 that extends along the first main surface 13 of the multilayer body 10 and between the multilayer body 10 and the part of the second outer electrode 22 that extends along the first main surface 13 of the multilayer body 10.

In a multilayer coil component according to an embodiment of the present disclosure, the first outer electrode 21 and the second outer electrode 22 may be provided so as to respectively extend from the first end surface 11 and the second end surface 12 and cover part of the second main surface 14.

Figure 8:
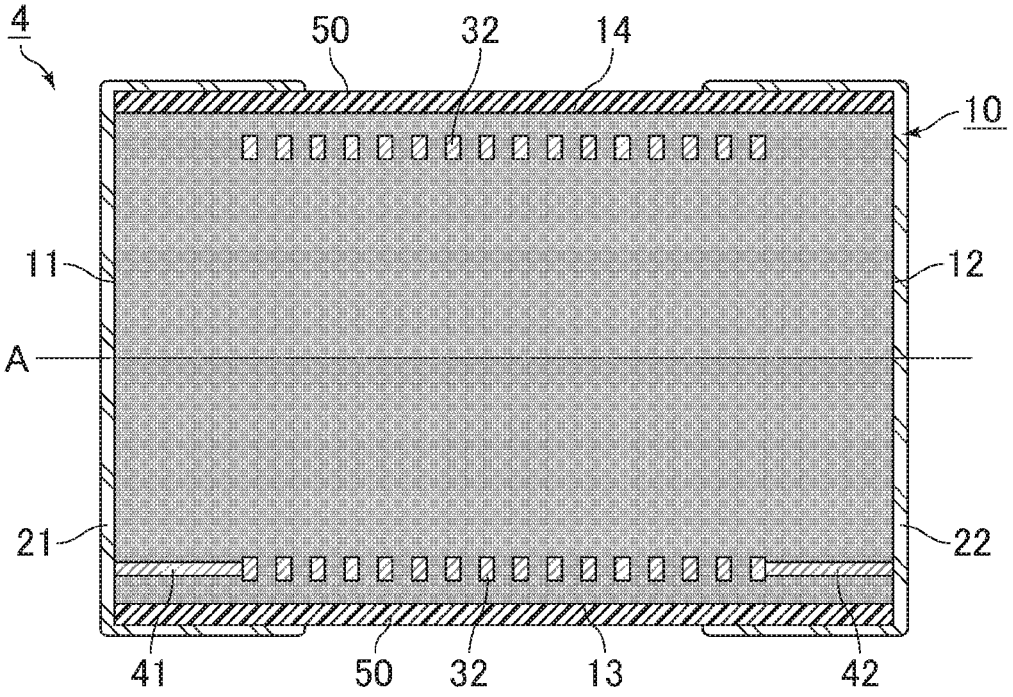
FIG. 8 is a sectional view schematically illustrating yet another example of a multilayer coil component according to an embodiment of the present disclosure.
Figure 9A:
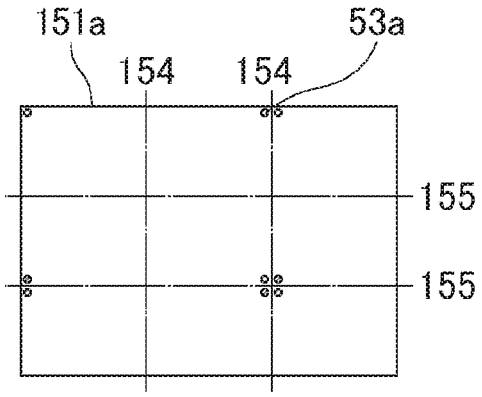
FIGS. 9A, 9B, 9C, 9D, 9E, 9F, and 9G are plan views schematically illustrating examples of coil sheets that are stacked on top of one another to form a mother multilayer body.
Figure 9B:
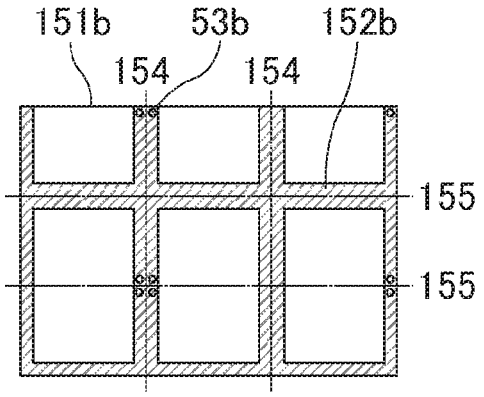
Figure 9C:
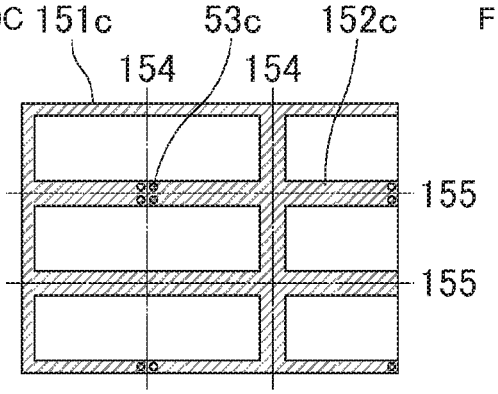
Figure 9D:
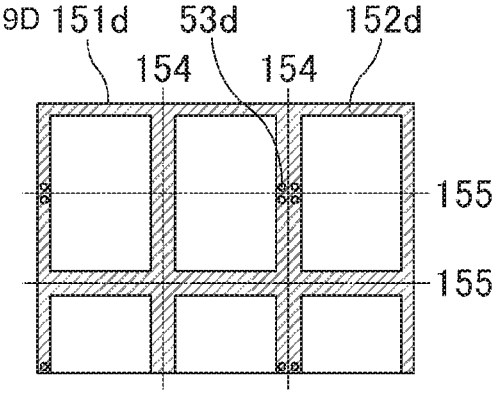
Figure 9E:
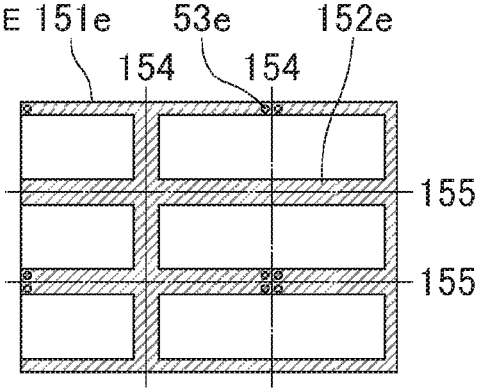
Figure 9F:
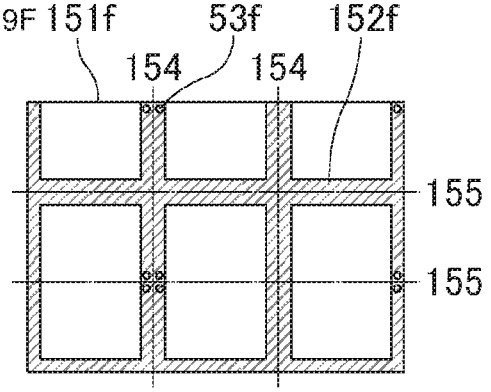
Figure 9G:
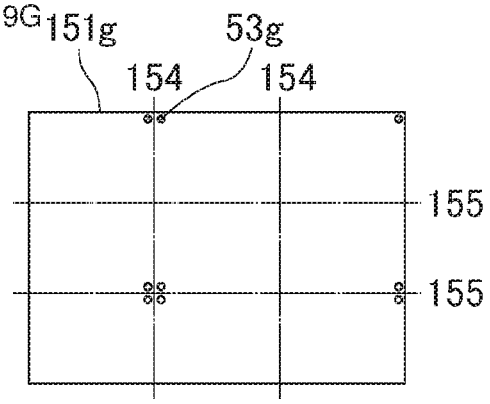

FIG. 8 is a sectional view schematically illustrating yet another example of a multilayer coil component according to an embodiment of the present disclosure. In a multilayer coil component 4 illustrated in FIG. 8, the first outer electrode 21 extends from the first end surface 11 and covers part of the second main surface 14 and the second outer electrode 22 extends from the second end surface 12 and covers part of the second main surface 14. A low-dielectric-constant layer 50 is provided between the multilayer body 10 and the parts of the first outer electrode 21 and second outer electrode 22 that extend along the first main surface 13 of the multilayer body 10 and a low-dielectric-constant layer 50 is provided between the multilayer body 10 and the parts of the first outer electrode 21 and second outer electrode 22 that extend along the second main surface 14 of the multilayer body 10.

In a multilayer coil component according to an embodiment of the present disclosure, the mounting surface is not particularly limited, but it is preferable that the first main surface 13, which is a surface along which the first outer electrode 21 and the second outer electrode 22 extend, be the mounting surface. Since the first outer electrode 21 and the second outer electrode 22 are provided so as to extend along the first main surface 13, mountability is high. On the other hand, a stray capacitance generated between the multilayer body 10 and the part of the first outer electrode 21 provided so as to extend along the first main surface 13 of the multilayer body 10 is increased, but in a multilayer coil component according to an embodiment of the present disclosure, since the low-dielectric-constant layer 50 is provided between the multilayer body 10 and the part of the first outer electrode 21 provided so as to extend along the first main surface 13, the generated stray capacitance is minimized and the radio-frequency characteristics can be improved. Even in the case where the first main surface 13 is not used as the mounting surface, since a stray capacitance generated due to an outer electrode extending along the first main surface 13 can be suppressed by the low-dielectric-constant layer 50, excellent radio-frequency characteristics are realized.

Specific examples of the preferred dimensions of the coil conductors and connection conductors will be described hereafter for cases where the size of the multilayer coil component 1 is the 0603 size, the 0402 size, and the 1005 size.

1. Multilayer coil component is 0603 size
   - The inner diameter (coil diameter) of each coil conductor preferably lies in a range from 50 μm to 100 μm in a plan view from the stacking direction.
   - The length of each connection conductor preferably lies in a range from 15 μm to 45 μm and more preferably lies in a range from 15 μm to 30 μm.
   - The width of each connection conductor preferably lies in a range from 30 μm to 60 μm.
2. Multilayer coil component 1 is 0402 size
   - The inner diameter (coil diameter) of each coil conductor preferably lies in a range from 30 μm to 70 μm in a plan view from the stacking direction.
   - The length of each connection conductor preferably lies in a range from 10 μm to 30 μm and more preferably lies in a range from 10 μm to 25 μm.
   - The width of each connection conductor preferably lies in a range from 20 μm to 40 μm.
3. Multilayer coil component 1 is 1005 size
   - The inner diameter (coil diameter) of each coil conductor preferably lies in a range from 80 μm to 170 μm in a plan view from the stacking direction.
   - The length of each connection conductor preferably lies in a range from 25 μm to 75 μm and more preferably lies in a range from 25 μm to 50 μm.
   - The width of each connection conductor preferably lies in a range from 40 μm to 100 μm.

A ferrite material is an example of the magnetic material included in the insulating layers. It is preferable that the ferrite material be a Ni—Zn—Cu ferrite material. In addition, it is preferable that the ferrite material contain Fe in the form of $Fe_2O_3$ at 40 to 49.5 mol %, Zn in the form of ZnO at 2 to 35 mol %, Cu in the form of CuO at 6 to 13 mol %, and Ni in the form of NiO at 10 to 45 mol %.

The ferrite material may also include inevitable impurities.

An example of the non-magnetic material included in the insulating layers is an oxide material containing Si and Zn (hereafter, also referred to as a first non-magnetic material). An example of such a material is a material represented by a general formula $aZnO\text{-}SiO_2$ and is a material having a value of a, that is, the content of Zn with respect to Si (Zn/Si) that lies in a range from 1.8 to 2.2. This material is also called willemite. In addition, it is preferable that the material further include Cu and specifically the material may be a material in which some of the Zn has been replaced with a dissimilar metal such as Cu. Such a material can be prepared by blending oxide raw materials (ZnO, $SiO_2$, CuO, etc.) so that the materials are at a prescribed molar ratio and mixing and pulverizing the materials in a wet state, and then calcining the mixture at a temperature in a range from 1000° C. to 1300° C.

Furthermore, another example of the non-magnetic material included in the insulating layers (hereafter, also referred to as a second non-magnetic material) is a material that includes a material obtained by adding a filler to a glass material containing Si, K, and B, the filler containing at least one selected from a group consisting of quartz and alumina. The glass material is preferably a material containing Si in the form of $SiO_2$ at 70 to 85 wt %, B in the form of $B_2O_3$ at 10 to 25 wt %, K in the form of $K_2O$ at 0.5 to 5 wt %, and Al in the form of $Al_2O_3$ at 0 to 5 wt %. This material can be prepared by mixing together a glass and a filler. For example, the material can be prepared by mixing together 40 to 60 parts by weight of quartz and 0 to 10 parts by weight of alumina as a filler with respect to 100 parts by weight of glass.

As a combination of the ferrite material and a nonmagnetic material, the ferrite material and the first non-magnetic material may be combined or the ferrite material and the second non-magnetic material may be combined. In addition, the ferrite material, the first non-magnetic material, and the second non-magnetic material may be combined. The combination consisting of the ferrite material and the first non-magnetic material is preferable.

The relative dielectric constant of the insulating layers is changed by changing the percentage of non-magnetic material contained in the insulating layers. It is preferable that the relative dielectric constant $E_{r1}$ of the insulating layers lie in a range from 12 to 20.

The low-dielectric-constant layer 50 is a layer having a smaller relative dielectric constant than the insulating layers and at least contains a non-magnetic material. As the non-magnetic material contained in the low-dielectric-constant layer 50, the first non-magnetic material and the second non-magnetic material contained in the insulating layers can be used and it is preferable that the first non-magnetic material be used. The low-dielectric-constant layer 50 may include a magnetic material in addition to a non-magnetic material. The same magnetic material as that included in the insulating layers may be used as the magnetic material included in the low-dielectric-constant layer 50.

The relative dielectric constant $\varepsilon_{r2}$ of the low-dielectric-constant layer 50 preferably lies in a range from 5 to 10. The low-dielectric-constant layer 50 is preferably formed of a composite material including a magnetic material and a non-magnetic material. The non-magnetic material preferably includes an oxide material containing Si and Zn and the content of Zn with respect to Si (Zn/Si) of the oxide material preferably lies in a range from 1.8 to 2.2 in terms of a molar ratio.

As a method of making the relative dielectric constant $\varepsilon_{r2}$ of the low-dielectric-constant layer 50 smaller than the relative dielectric constant $\varepsilon_{r1}$ of the insulating layers, a method in which the percentage of the non-magnetic material contained in the low-dielectric-constant layer 50 is made larger than the percentage of the non-magnetic material contained in the insulating layers may be used.

The thickness of the low-dielectric-constant layer 50 is not particularly limited, but preferably lies in a range from 10 μm to 15 μm.

In a multilayer coil component according to an embodiment of the present disclosure, the low-dielectric-constant layer 50 may also be provided between the multilayer body 10 and the part of the second outer electrode 22 that extends along the first main surface 13. Furthermore, the low-dielectric-constant layer 50 may be provided along a part of the first main surface 13 of the multilayer body 10 where the first outer electrode 21 and the second outer electrode 22 are not provided.

Method of Manufacturing Multilayer Coil Component

Hereafter, an example of a method of manufacturing a multilayer coil component according to an embodiment of the present disclosure will be described.

First, ceramic green sheets, which will form the insulating layers, are manufactured. For example, an organic binder such as a polyvinyl butyral resin, an organic solvent such as ethanol or toluene, and a dispersant are added to a magnetic material and a non-magnetic material and the resultant mixture is kneaded to form a slurry. After that, ceramic green sheets having a thickness of around 12 μm are obtained using a method such as a doctor blade technique.

For example, as a ferrite material serving as the magnetic material, a Ni—Zn—Cu ferrite material (oxide mixed powder) having an average particle diameter of about 2 μm can be used that is obtained by mixing together iron, nickel, zinc and copper oxide raw materials, calcining the raw materials at 800° C. for 1 hour, pulverizing the mixture using a ball mill, and then drying the resulting mixture. In addition, it is preferable that the ferrite material contain Fe in the form of $Fe_2O_3$ at 40 to 49.5 mol %, Zn in the form of ZnO at 2 to 35 mol %, Cu in the form of CuO at 6 to 13 mol %, and Ni in the form of NiO at 10 to 45 mol %.

As the non-magnetic material, an oxide material containing Si and Zn (above-described first non-magnetic material) can be used. Such a material can be prepared by blending oxide raw materials (ZnO, $SiO_2$, CuO, etc.) so that the materials are at a prescribed molar ratio and mixing and pulverizing the materials in a wet state, and then calcining the mixture at a temperature in a range from 1000° C. to 1300° C.

Furthermore, as the non-magnetic material, a material (above-described second non-magnetic material) that includes a material obtained by adding a filler to a glass material containing Si, K, and B, the filler containing at least one selected from a group consisting of quartz and alumina can be used. The glass material is preferably a material containing Si in the form of $SiO_2$ at 70 to 85 wt %, B in the form of $B_2O_3$ at 10 to 25 wt %, K in the form of $K_2O$ at 0.5 to 5 wt %, and Al in the form of $Al_2O_3$ at 0 to 5 wt %. This material can be prepared by mixing together a glass and a filler. For example, the material can be prepared by mixing together 40 to 60 parts by weight of quartz and 0 to 10 parts by weight of alumina as a filler with respect to 100 parts by weight of glass.

Via holes having a diameter of around 20 μmm to 30 μmm are formed by subjecting the manufactured ceramic green sheets to prescribed laser processing. Using a Ag paste on specific sheets having via holes, coil sheets are formed by filling the via holes and screen-printing and drying prescribed conductor patterns (coil conductors) having a thickness of around 11 μm.

The coil sheets are stacked in a prescribed order so that a coil having a looping axis (coil axis) in a direction parallel to the mounting surface is formed in the multilayer body after division into individual components. In addition, via sheets, in which via conductors that will form the connection conductors are formed, are stacked above and below the coil sheets.

The multilayer body is subjected to thermal pressure bonding in order to obtain a pressure-bonded body, and then the pressure-bonded body is cut into pieces of a predetermined chip size to obtain individual chips. The divided chips may be processed using a rotary barrel in order to round the corner portions and edge portions thereof.

Next, a low-dielectric-constant ceramic green sheet, which will form the low-dielectric-constant layer, is manufactured. Other than adjusting the mixing ratio of the magnetic material and the non-magnetic material so that the relative dielectric constant of the low-dielectric-constant ceramic green sheet is smaller than the relative dielectric constant of the ceramic green sheets that will form the insulating layers, the low-dielectric-constant ceramic green sheet is manufactured using the same procedure as that used to manufacture the ceramic green sheets that will form the insulating layers.

The obtained low-dielectric-constant ceramic green sheet is adhered to the surface, which will become the first main surface, of each divided chip and then binder removal and firing is performed at a prescribed temperature and for a prescribed period of time, and as a result a fired body (multilayer body) having a coil built into the inside thereof and having a low-dielectric-constant layer on the first main surface thereof is obtained.

In addition, although the low-dielectric-constant layer was already provided on the first main surface of the multilayer body obtained through the above procedure, alternately, a multilayer body equipped with the low-dielectric-constant layer may be obtained not by adhering the low dielectric constant ceramic green sheet to the surfaces of chips (multilayer bodies) that have been subjected to binder removal and firing but rather by subjecting the divided chips to binder removal and firing to obtain multilayer bodies, then adhering the low-dielectric-constant ceramic green sheet to the first main surface of each multilayer body, and then subjecting each multilayer body together with the low-dielectric-constant ceramic green sheet to binder removal and firing.

The low-dielectric-constant ceramic green sheet may be adhered to the entirety of the first main surface of the multilayer body, may be adhered to only the region of the first main surface where the first outer electrode will be formed, or may be adhered to both the region of the first main surface where the first outer electrode will be formed and the region of the first main surface where the second outer electrode will be formed. In addition, instead of using a method in which the low-dielectric-constant ceramic green sheet is adhered to the first main surface of the multilayer body, a method may be used in which a slurry for forming the low-dielectric-constant ceramic green sheet is applied to the first main surface of the multilayer body and then dried and fired.

The chips are dipped at an angle in a layer obtained by spreading Ag paste to a predetermined thickness and then baked to form a base electrode of an outer electrode on four surfaces (a main surface, an end surface, and both side surfaces) of the multilayer body. At this time, the base electrode is formed so that the paste contacts the first main surface and as a result the base electrode is also formed on the surface of the low-dielectric-constant layer. In the above-described method, the base electrode can be formed in one go in contrast to the case where the base electrode is formed separately on the main surface and the end surface of the multilayer body in two steps. A base electrode of an outer electrode can be formed on five surfaces of the multilayer body (four surfaces consisting of adjacent main surfaces and side surfaces in addition to the respective end surface) when a method is used in which a chip is vertically dipped in a layer formed by spreading Ag paste to a prescribed thickness.

Formation of the outer electrodes is completed by sequentially forming a Ni film and a Sn film having predetermined thicknesses on the base electrodes by performing plating. Since the low-dielectric-constant layer has been provided between the first main surface of the multilayer body and the base electrode, the low-dielectric-constant layer is provided between the outer electrode formed using the above-described steps and the first main surface of the multilayer body. A multilayer coil component according to an embodiment of the present disclosure can be manufactured as described above.

Figure 10:
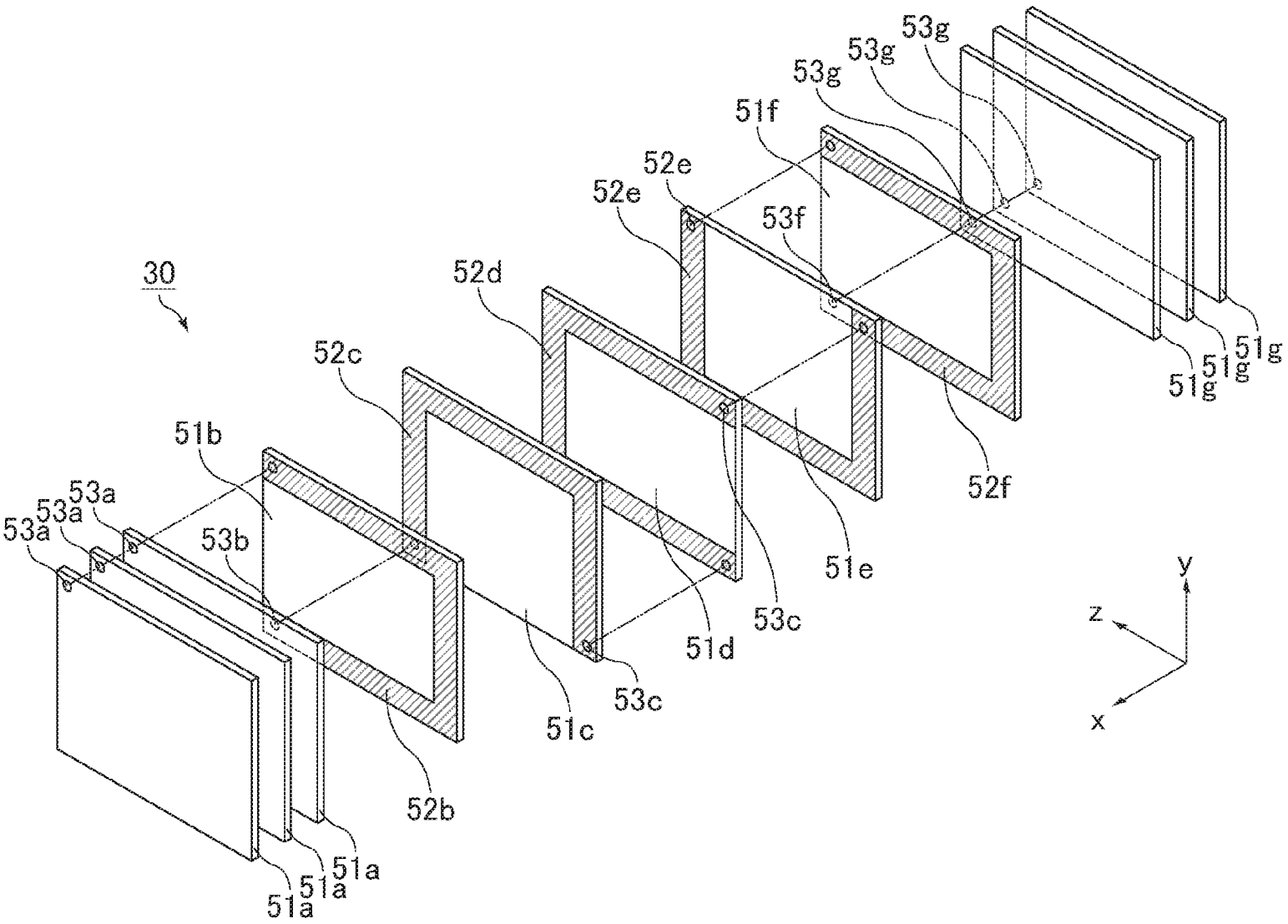
FIG. 10 is an exploded perspective view schematically illustrating an example of a multilayer body obtained by cutting the mother multilayer body into individual chips.

Another example of a method of manufacturing a multilayer coil component according to an embodiment of the present disclosure will be described while referring to FIGS. 9A, 9B, 9C, 9D, 9E, 9F, and 9G and FIGS. 10 to 13. FIGS. 9A, 9B, 9C, 9D, 9E, 9F, and 9G are plan views that schematically illustrate examples of coil sheets that are stacked on top of one another to form a mother multilayer body. FIG. 10 is an exploded perspective view that schematically illustrates an example of a multilayer body obtained by cutting the mother multilayer body obtained by stacking the coil sheets illustrated in 9A, 9B, 9C, 9D, 9E, 9F, and 9G on top of one another. In FIGS. 9A, 9B, 9C, 9D, 9E, 9F, and 9G, cutting lines 154 and 155 are illustrated, which are lines along which the obtained mother multilayer body is to be cut into individual chips.

In FIGS. 9A, 9B, 9C, 9D, 9E, 9F, and 9G, via conductors 53*a*, 53*b*, 53*c*, 53*d*, 53*e*, 53*f*, and 53*g* are respectively formed in insulating sheets 151*a*, 151*b*, 151*c*, 151*d*, 151*e*, 151*f*, and 151*g*, which will form insulating layers 51*a*, 51*b*, 51*c*, 51*d*, 51*e*, 51*f*, and 51*g* that form a multilayer body 30 illustrated in FIG. 10.

In addition, coil conductor patterns 152*b*, 152*c*, 152*d*, 152*e*, and 152*f* are respectively formed on the insulating sheets 151*b*, 151*c*, 151*d*, 151*e*, and 151*f*, which will form the insulating layers 51*b*, 51*c*, 51*d*, 51*e*, and 51*f*. The coil conductor patterns 152*b* to 152*f* are provided on the insulating sheets 151*b* to 151*f* so that the coil conductors in adjacent multilayer bodies are separated from each other.

By stacking these insulating sheets on top of one another, a mother multilayer body is obtained that includes a plurality of stacked insulating sheets, a plurality of coil conductor patterns provided between the insulating sheets, and one or more via conductors that penetrate through the insulating sheets in the stacking direction.

The obtained mother multilayer body is divided into a plurality of unfired multilayer bodies by cutting the mother multilayer body into individual chips using a dicer or the like. FIG. 10 is an exploded perspective view schematically illustrating an example of a multilayer body obtained by cutting the mother multilayer body into individual chips. The mother multilayer body is divided into nine multilayer bodies by cutting the mother multilayer body along the cutting lines 154 and 155. In reality, a mother multilayer body would be divided into a greater number of multilayer bodies. A coil is formed in each multilayer body 30 as a result of the plurality of coil conductors 52*b* to 52*f* provided between the plurality of stacked insulating layers 51*a* to 51*g* and the one or more via conductors 53*a* to 53*g*, which penetrate through the insulating layers 51*a* to 51*g* in the stacking direction, being connected to each other.

The coil conductors 52*b*, 52*c*, 52*d*, 52*e*, and 52*f* are respectively provided on main surfaces of the insulating layers 51*b*, 51*c*, 51*d*, 51*e*, and 51*f*. The coil conductors 52*b* to 52*f* are substantially shaped like a square U and have a length equivalent to ¾ of a turn.

Figure 11:
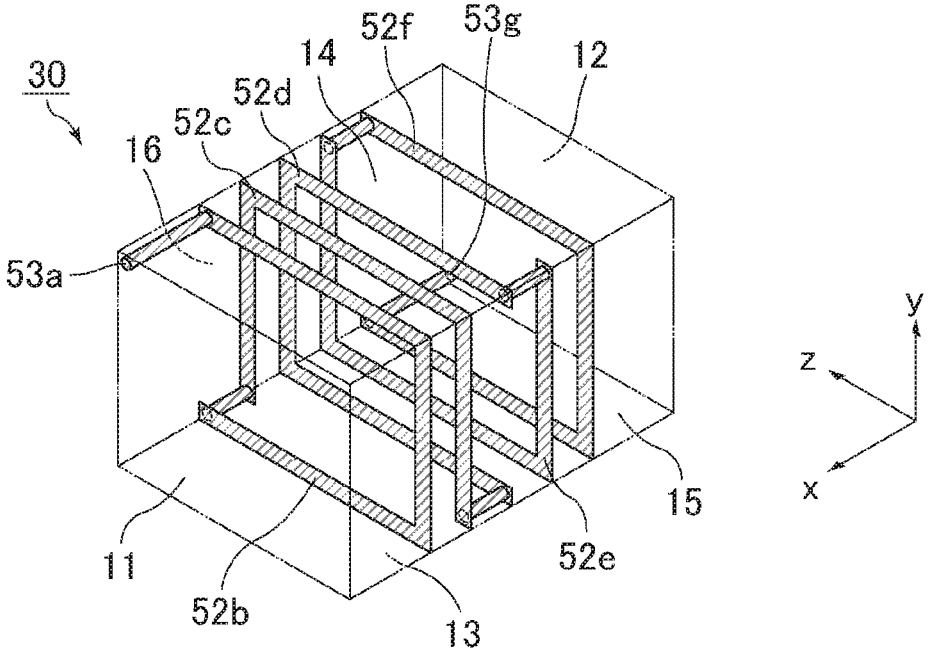
FIG. 11 is a transparent perspective view schematically illustrating the state of the coil conductors inside the multilayer body illustrated in FIG. 10.

FIG. 11 is a transparent perspective view schematically illustrating the state of coil conductors inside the multilayer body illustrated in FIG. 10. As illustrated in FIG. 11, the coil conductors 52*b*, 52*c*, 52*d*, 52*e*, and 52*f* are connected to each other by the via conductors 53*b*, 53*c*, 53*d*, and 53*e*, thereby forming a coil inside the multilayer body 30. In addition, as illustrated in FIGS. 9 and 11, the first main surface 13 and the second main surface 14 of the multilayer bodies 30 are surfaces that are revealed when cutting is performed along the cutting lines 155 and the first side surface 15 and the second side surface 16 of the multilayer bodies 30 are surfaces that are revealed when cutting is performed along the cutting lines 154. The coil conductors 52*b* to 52*f* are exposed at the first main surface 13, second main surface 14, first side surface 15, or second side surface 16 of each multilayer body 30. Furthermore, the via conductor 53*a* is exposed at the first end surface 11 of the multilayer body 30 and the via conductor 53*g* is exposed at the second end surface 12 of the multilayer body 30.

Figure 12:
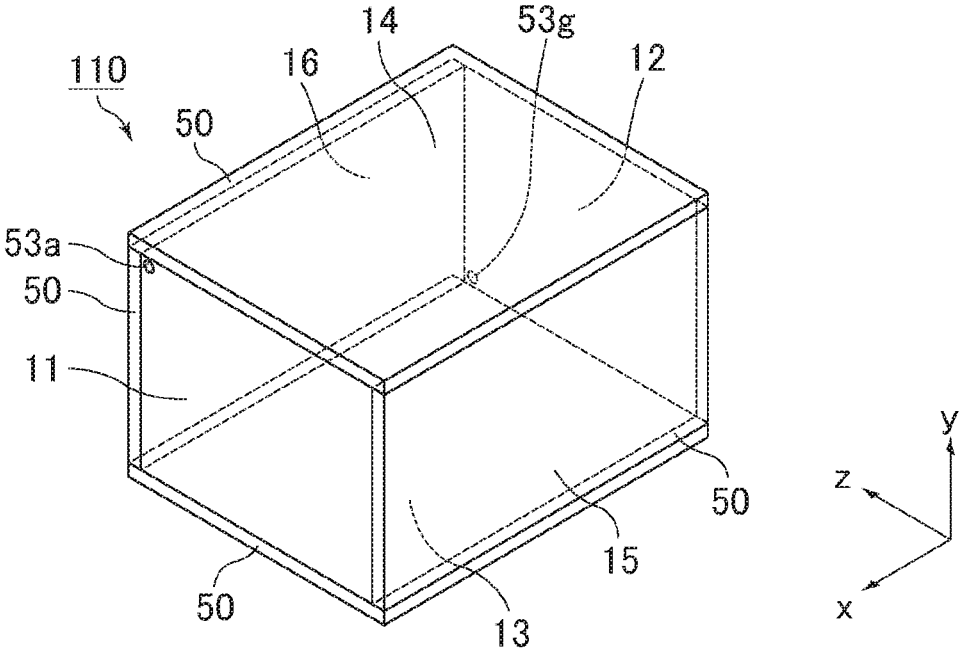
FIG. 12 is a perspective view schematically illustrating an example of a case in which low-dielectric-constant layers are arranged on the multilayer body illustrated in FIG. 10.
Figure 13:
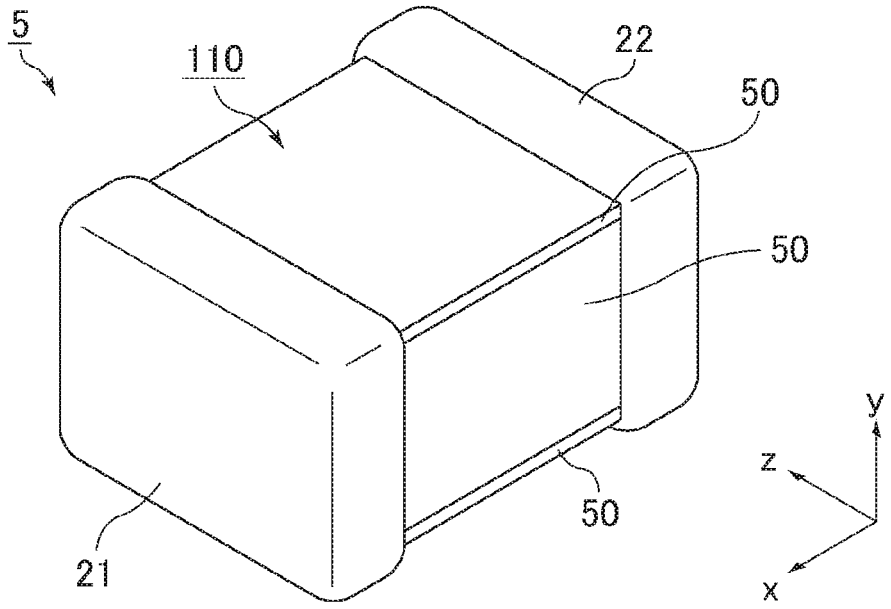
FIG. 13 is a perspective view schematically illustrating an example of a case in which outer electrodes are provided on the multilayer body illustrated in FIG. 12.

FIG. 12 is a perspective view schematically illustrating an example of a case in which the low-dielectric-constant layers 50 are arranged on the multilayer body 30 illustrated in FIG. 10 and FIG. 13 is a perspective view schematically illustrating an example of a case in which the outer electrodes 21 and 22 are provided on the multilayer body 30 illustrated in FIG. 12. As illustrated in FIG. 12, a structure 110 can be obtained in which the low-dielectric-constant layers 50 are provided on the first main surface 13, the second main surface 14, the first side surface 15, and the second side surface 16 of the multilayer body 30 by adhering the low-dielectric-constant ceramic green sheets to the first main surface 13, the second main surface 14, the first side surface 15, and the second side surface 16 of the multilayer body 30. In addition, a multilayer coil component 5 as illustrated in FIG. 13 can be obtained by forming the first outer electrode 21 and the second outer electrode 22 so as to be disposed on the first end surface 11 and the second end surface 12 and extend from each of the first end surface 11 and the second end surface 12 of the multilayer body 30 along the first main surface 13, the second main surface 14, the first side surface 15, and the second side surface 16 of the multilayer body 30. The first outer electrode 21 extends from the first end surface 11 of the multilayer body 30 along part of each of the first main surface 13, the second main surface 14, the first side surface 15, and the second side surface 16 and the second outer electrode 22 extends from the second end surface 12 of the multilayer body 30 along part of each of the first main surface 13, the second main surface 14, the first side surface 15, and the second side surface 16. In the multilayer coil component 5, the low-dielectric-constant layer 50 is provided over the entirety of the first main surface 13 of the multilayer body 30, and therefore the low-dielectric-constant layer 50 is arranged between the multilayer body 30 and the parts of the first outer electrode 21 and the second outer electrode 22 that extend along the first main surface 13 of the multilayer body 30.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A multilayer coil component comprising:

a multilayer body that is formed by stacking a plurality of insulating layers on top of one another in a length direction and that has a coil built into the inside thereof; and a first outer electrode and a second outer electrode that are electrically connected to the coil;

wherein the coil is formed by a plurality of coil conductors stacked in the length direction together with the insulating layers being electrically connected to each other, the multilayer body has a first end surface and a second end surface, which face each other in the length direction, a first main surface and a second main surface, which face each other in a height direction perpendicular to the length direction, and a first side surface and a second side surface, which face each other in a width direction perpendicular to the length direction and the height direction, the first outer electrode extends along and covers at least a portion of the first end surface and a portion of the first main surface, the second outer electrode extends along and covers at least a portion of the second end surface and a portion of the first main surface, a stacking direction of the multilayer body and a coil axis direction of the coil are parallel to the first main surface, a low-dielectric-constant layer having a smaller relative dielectric constant than the insulating layers is provided between the multilayer body and a portion of the first outer electrode that extends along the first main surface, and the first outer electrode is in direct contact with the first end surface and does not directly contact the first main surface.

2. The multilayer coil component according to claim 1, wherein the low-dielectric-constant layer is further provided between the multilayer body and a portion of the second outer electrode that extends along the first main surface.

3. The multilayer coil component according to claim 2, wherein the low-dielectric-constant layer is provided along an entirety of the first main surface of the multilayer body.

4. The multilayer coil component according to claim 1, wherein the first main surface is a mounting surface.

5. The multilayer coil component according to claim 1, wherein a relative dielectric constant $\varepsilon_{r1}$ of the insulating layers is in a range from 12 to 20, and a relative dielectric constant $\varepsilon_{r2}$ of the low-dielectric-constant layer is in a range from 5 to 10.

6. The multilayer coil component according to claim 1, wherein the low-dielectric-constant layer is made of a composite material including a magnetic material and a non-magnetic material.

7. The multilayer coil component according to claim 6, wherein the non-magnetic material includes an oxide material containing Si and Zn, and content of Zn relative to Si (Zn/Si) is in a range from 1.8 to 2.2 in terms of a molar ratio.

8. The multilayer coil component according to claim 2, wherein the first main surface is a mounting surface.

9. The multilayer coil component according to claim 3, wherein the first main surface is a mounting surface.

10. The multilayer coil component according to claim 2, wherein a relative dielectric constant $\varepsilon_{r1}$ of the insulating layers is in a range from 12 to 20, and a relative dielectric constant $\varepsilon_{r2}$ of the low-dielectric-constant layer is in a range from 5 to 10.

11. The multilayer coil component according to claim 3, wherein a relative dielectric constant $\varepsilon_{r1}$ of the insulating layers is in a range from 12 to 20, and a relative dielectric constant $\varepsilon_{r2}$ of the low-dielectric-constant layer is in a range from 5 to 10.

12. The multilayer coil component according to claim 4, wherein a relative dielectric constant $\varepsilon_{r1}$ of the insulating layers is in a range from 12 to 20, and a relative dielectric constant $\varepsilon_{r2}$ of the low-dielectric-constant layer is in a range from 5 to 10.

13. The multilayer coil component according to claim 2, wherein the low-dielectric-constant layer is made of a composite material including a magnetic material and a non-magnetic material.

14. The multilayer coil component according to claim 3, wherein the low-dielectric-constant layer is made of a composite material including a magnetic material and a non-magnetic material.

15. The multilayer coil component according to claim 4, wherein the low-dielectric-constant layer is made of a composite material including a magnetic material and a non-magnetic material.

16. The multilayer coil component according to claim 5, wherein the low-dielectric-constant layer is made of a composite material including a magnetic material and a non-magnetic material.

17. The multilayer coil component according to claim 13, wherein the non-magnetic material includes an oxide material containing Si and Zn, and content of Zn relative to Si (Zn/Si) is in a range from 1.8 to 2.2 in terms of a molar ratio.

18. The multilayer coil component according to claim 14, wherein the non-magnetic material includes an oxide material containing Si and Zn, and content of Zn relative to Si (Zn/Si) is in a range from 1.8 to 2.2 in terms of a molar ratio.

19. The multilayer coil component according to claim 15, wherein the non-magnetic material includes an oxide material containing Si and Zn, and content of Zn relative to Si (Zn/Si) is in a range from 1.8 to 2.2 in terms of a molar ratio.

20. The multilayer coil component according to claim 16, wherein the non-magnetic material includes an oxide material containing Si and Zn, and content of Zn relative to Si (Zn/Si) is in a range from 1.8 to 2.2 in terms of a molar ratio.

* * * * *